US005575089A

United States Patent [19]

Giese et al.

[11] Patent Number: 5,575,089

[45] **Date of Patent: *Nov. 19, 1996**

[54] COMPOSITE SHOE CONSTRUCTION

[75] Inventors: Erik O. Giese; Roger J. Brown, both of Aspen, Colo.

[73] Assignee: Comfort Products, Inc., Aspen, Colo.

[ * ] Notice: The portion of the term of this patent subsequent to Jun. 25, 2008, has been disclaimed.

[21] Appl. No.: 335,562

[22] Filed: Oct. 31, 1994

Related U.S. Application Data

[63] Continuation-in-part of Ser. No. 55,935, Apr. 30, 1993, abandoned, which is a continuation-in-part of Ser. No. 649,525, Feb. 1, 1991, abandoned, which is a continuation of Ser. No. 871,017, Jun. 4, 1986, Pat. No. 5,025,573.

[51] Int. Cl.[6] ..... A43B 13/14; A43B 13/12

[52] U.S. Cl. ..... 36/30 R; 36/31; 36/28

[58] Field of Search ..... 36/30 R, 31, 28, 36/32 R, 25 R, 103, 92, 82, 107, 108, 76 R, 76 C, 22 A, 11.5, 11, 12

[56] References Cited

U.S. PATENT DOCUMENTS

| | | | |
|---|---|---|---|
| 193,914 | 8/1877 | Berry | 36/11 |
| 1,803,554 | 5/1931 | Knilans | 36/12 |
| 2,502,774 | 4/1950 | Alianiello | 36/28 |
| 4,124,946 | 11/1978 | Tomlin | 36/43 |
| 4,161,828 | 7/1979 | Benseler et al. | 36/32 |
| 4,213,255 | 7/1980 | Olberz et al. | 36/32 |
| 4,399,620 | 8/1983 | Funck | 36/30 |
| 4,542,598 | 9/1985 | Misevich et al. | 36/107 X |
| 4,547,979 | 10/1985 | Harada et al. | 36/30 |
| 4,551,929 | 11/1985 | Paris | 36/11 |
| 4,667,423 | 5/1987 | Autry et al. | 36/102 |
| 4,676,010 | 6/1987 | Cheskin | 36/32 |
| 4,677,767 | 7/1987 | Darby | 36/102 |
| 4,694,591 | 9/1987 | Banich et al. | 36/102 |
| 4,736,531 | 4/1988 | Richard | 36/114 |
| 4,759,136 | 7/1988 | Stewart et al. | 36/114 |
| 4,798,010 | 1/1989 | Sugiyama | 36/30 |
| 4,831,750 | 5/1989 | Muller | 36/28 |
| 4,858,340 | 8/1989 | Pasternak | 36/12 |
| 5,025,573 | 6/1991 | Giese et al. | 36/30 |

FOREIGN PATENT DOCUMENTS

| | | | |
|---|---|---|---|
| 3635831A1 | 5/1988 | Germany . | |
| 8821 | of 1890 | United Kingdom | 36/11 |
| WO83/04166 | 12/1983 | WIPO . | |

*Primary Examiner*—Ted Kavanaugh
*Attorney, Agent, or Firm*—Pennie & Edmonds

[57] ABSTRACT

The present invention provides a composite shoe bottom that has a lower shaped support layer with a lower surface and an increased height around the periphery of the heel area and an irregular contoured upper stabilizing surface for the wearer's foot; a shoe upper superimposed upon the upper surface of the lower layer; an upper cushioning layer of a material that is softer than the lower layer, the upper layer having a varying thickness which is pre-shaped to a contour complementary to the bottom surface of the wearer's foot and having an increased height around the periphery of the heel area and in the arch area to form a raised arch support and to provide an irregular contoured upper stabilizing surface for the wearer's foot; and means for forming an outsole secured to at least a portion of the lower surface of the lower support layer and comprising at least one strip of a wear resistant material which is positioned upon the lower layer in an area which will experience abrasion or shock.

29 Claims, 9 Drawing Sheets

COMPOSITE SHOE CONSTRUCTION

CROSS-REFERENCE TO RELATED APPLICATIONS

This is a continuation-in-part of application Ser. No. 08/055,935, filed Apr. 30, 1993, now abandoned, which is a continuation-in-part of application Ser. No. 07/649,525, filed Feb. 1, 1991, now abandoned, which is a continuation of application Ser. No. 06/871,017, filed Jun. 4, 1986, now U.S. Pat. No. 5,025,573.

FIELD OF THE INVENTION

This invention relates to shoes. In particular, this invention relates to improvements in the configurations and materials used in the construction of shoe bottoms for various types of footwear.

BACKGROUND OF THE INVENTION

Historically, shoe bottoms have been constructed for the most part with flat top and bottom surfaces. This sort of shoe bottom was normally made of single density polyurethane (PU) or blown polyvinylchloride (PVC) materials. The upper of the shoe would be glued onto the top of the sole or the upper could be "direct attached" through a molding process that would capture the upper in the molded sole. The bottom could be the lowermost layer of the sole if the urethane was sufficiently abrasion-resistant. Alternatively, a rubber outsole could be cemented onto the unit bottom, as is typically done in the manufacture of running shoes.

Eventually, it became known to contour the top surface of the bottom unit to provide a heel cup and a slight arch. This made the shoe more comfortable because the foot would rest on a surface similar to its shape as opposed to a flat surface which felt like flat feet on a firm floor.

When the contour surface is used with a dual-density bottom, that is, two different densities of PU, the lowermost (outer) portion is formed of a uniform thickness. This portion can be used for its abrasion resistance. The softer portion is positioned on top of this uniform portion to provide comfort and cushioning, since the firmer material would be too hard for comfort. Further, the respective volumes of the softer and firmer materials are such that the volume of soft material is maximized and the volume of firmer material is minimized.

The prior known structures have always had to trade cushioning for stability. If the bottom is soft for good cushioning, then the foot rocks from side to side, which is unstable. Even existing soles with contoured topmost surfaces have this type of trade-off. It has been proposed, for example, in U.S. Pat. Nos. 4,399,620 (Funck) and 4,446,633 (Scheinhaus et al.) to contour the lower wear-resistant layer but to provide a relatively flat second layer that is deformable rather than double contoured. The designs taught in each of these patents, however, provides a flat surface that must be deformed by the foot to obtain a satisfactory shape, thus losing much of the support which was to be provided by the bottom.

SUMMARY OF THE INVENTION

The present invention provides a composite shoe bottom that has a lower shaped support layer with a lower surface and an increased height relative to other portions of the lower layer around the periphery of the heel area and an irregular contoured upper stabilizing surface for the wearer's foot; an upper cushioning layer of a material that is softer than said lower layer, said upper layer having a varying thickness which is pre-shaped to a contour complementary to the bottom surface of the wearer's foot and having an increased height relative to other portions of the upper layer around the periphery of the heel area and in the arch area to form a raised arch support and to provide an irregular contoured upper stabilizing surface for the wearer's foot; and means for forming an outsole secured to at least a portion of the lower surface of the lower support layer and comprising at least one strip of a wear resistant material which is positioned upon the lower layer in an area which will experience abrasion or shock.

DETAILED DESCRIPTION OF THE INVENTION

Figure 1:
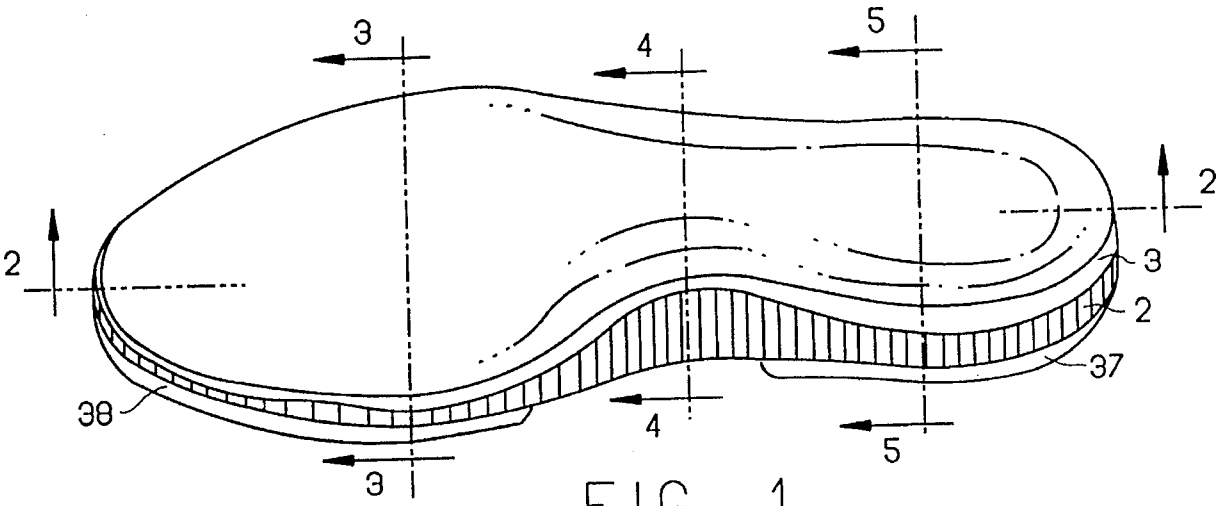
FIG. 1 is a perspective view of one embodiment of the invention.
Figure 2:
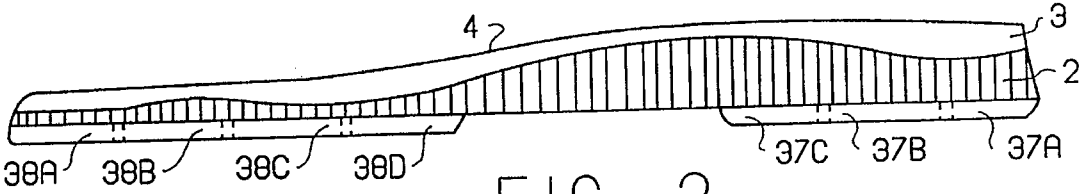
FIG. 2 is a transverse cross-section along lines 2—2 of FIG. 1.
Figure 4:
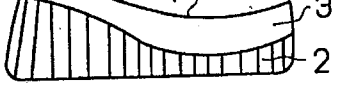
FIG. 4 is a transverse cross-section along lines 4—4 of FIG. 1.

FIGS. 1–5 show a composite shoe bottom according to the invention. In this embodiment, the outsole is formed of various pieces or strips of wear-resistant material, which may be placed adjacent each other with or without spaces between them. When these strips are spaced or contain a gap between them, the flexibility of the sole is enhanced. As shown in FIGS. 1 and 2, wear-resistant outsole materials 37 and 38 are provided at least in the areas of the heel and beneath the ball of the foot in the toe portion. The material used for these outsole layers 37, 38 is preferably rubber or an abrasion-resistant polyurethane which is harder than the polyurethane of the upper or lower layers, or other similar materials. These outsole materials provide traction and abrasion resistance such that the shoe may have a relatively long useful life. When the outsole materials 37 and 38 are made of high density polyurethane, they can be integrally molded with the other layers. Otherwise, the outsole materials may be glued, ultrasonically welded or otherwise attached to the molded combination of the upper and lower layers.

Figure 5:
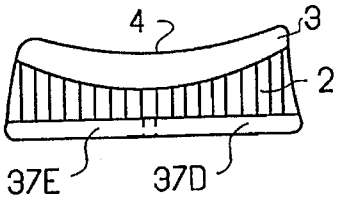
FIG. 5 is a transverse cross-section along lines 5—5 of FIG. 1.
Figure 3:
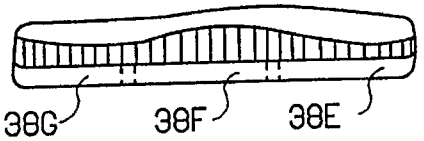
FIG. 3 is a transverse cross-section along lines 3—3 of FIG. 1.

It is not necessary for the outsole materials 37 and 38 to be used in complete pieces in this embodiment, as it is also contemplated that a series of strips of such materials 37A, 37B, 37C, 38A, 38B, 38C, 38D, as shown in FIG. 2, can be used. In this arrangement, some of the strips can be made of harder materials than the others for placement in the portions of the sole which experience the greatest degree of wear or abrasion. These strips can be applied horizontally as shown in FIG. 2 or vertically as shown in FIGS. 3 and 5. Also, although not shown in these Figures, these strips can extend along the complete bottom of the lower layer to form a complete outsole. Also, spaces can be provided between these strips to increase the flexibility of the sole.

Figure 1A:
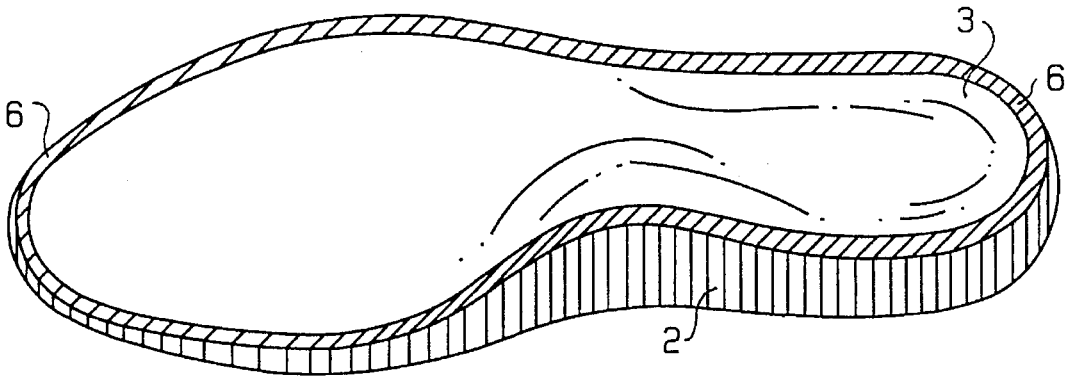
FIG. 1A is a perspective view of another embodiment of the invention.

Another variation of the invention is shown in FIG. 1A, which is identical to FIG. 1 except that the lower layer extends completely around and surrounds the upper layer. In this arrangement, the greatest degree of lateral support is provided to both the upper layer and the user's foot. Furthermore, when the lower layer 2 is made of a relatively harder polyurethane material that has abrasion resistant properties, it may be molded to a form which would include pieces 37 and 38. In addition, it is possible to mold only certain strips (e.g., 38B, 38D, 37A) to be of a harder rubber, polyurethane or like material. The remaining strips or pieces of the sole can then be glued or otherwise attached to the lower layer. If desired, the harder materials can be first provided on the lower surface of the lower layer in the appropriate locations, and the remainder of the outsole can be formed by molding a different polyurethane into the spaces between the harder materials.

The lower and upper layers can have a variety of different configurations and can have shock inserts, stabilizers, or other additional components as shown in U.S. Pat. No. 5,025,573, the content of which is expressly incorporated herein by reference thereto.

Figure 6:
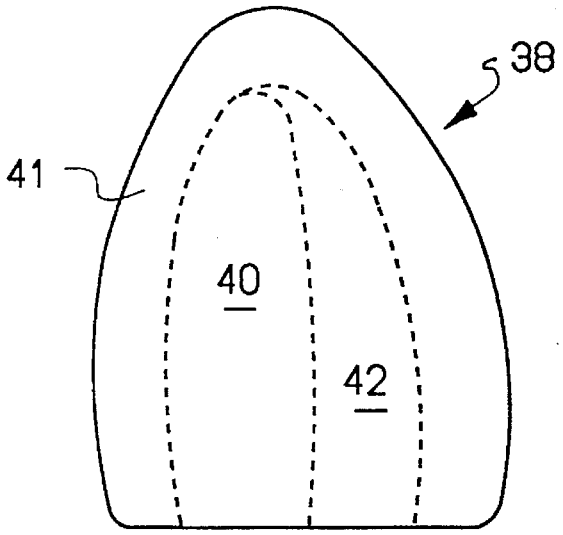
FIG. 6 is a bottom view of an alternative design for the toe portion of the shoe of FIG. 1.

FIG. 6 illustrates another way in which the sole portion 38 can be made with strips of different hardness materials. For example, portion 41, a peripheral band, can be made of the hardest material to facilitate the wear resistance of the shoe as it is worn and used, whereas portion 40 could be made of a slightly softer material to provide additional cushioning and suitable wear resistance. Portion 42 which does not experience anywhere near as much abrasion or wear as portions 40 and 41 can be made of a softer material for even greater cushioning of the foot.

Figure 7:
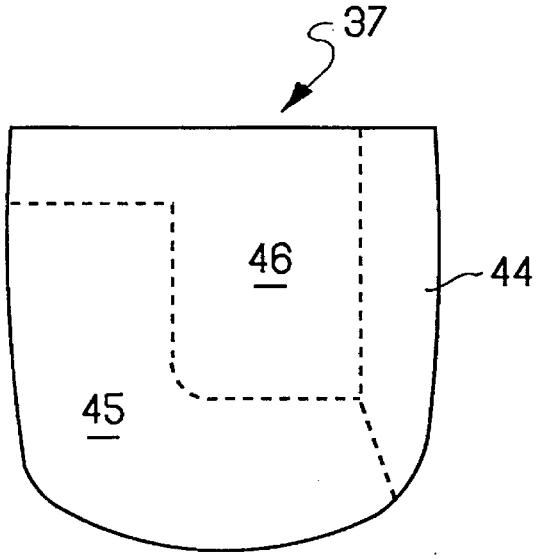
FIG. 7 is a bottom view of an alternative design for the heel portion of the shoe of FIG. 1.

Similarly, in FIG. 7, portion 45 can be made of the hardest and most wear resistant material used in the sole, since this area experiences the greatest stress and wear. Also, portion 44 can be made of a slightly softer wear-resistant material since abrasion and stress at that point is less. Portion 46 again can be a softer material for cushioning of the foot and for absorbing impact or shock while running, playing sports or conducting other strenuous activities. Different levels of effective cushioning can also be achieved by varying the thickness of the strips. In yet another embodiment, the hardest or thickest strips can be provided in the areas which will experience the highest degree of abrasion or wear, and the remainder of the outsole can be molded around the strips, i.e., in the gaps and spaces between the strips and the balance of the bottom side of the sole. If desired, threads or grooves may also be provided to facilitate traction or flexibility when the shoe is worn. These threads or grooves would typically be situated between the wear strips.

Figure 8:
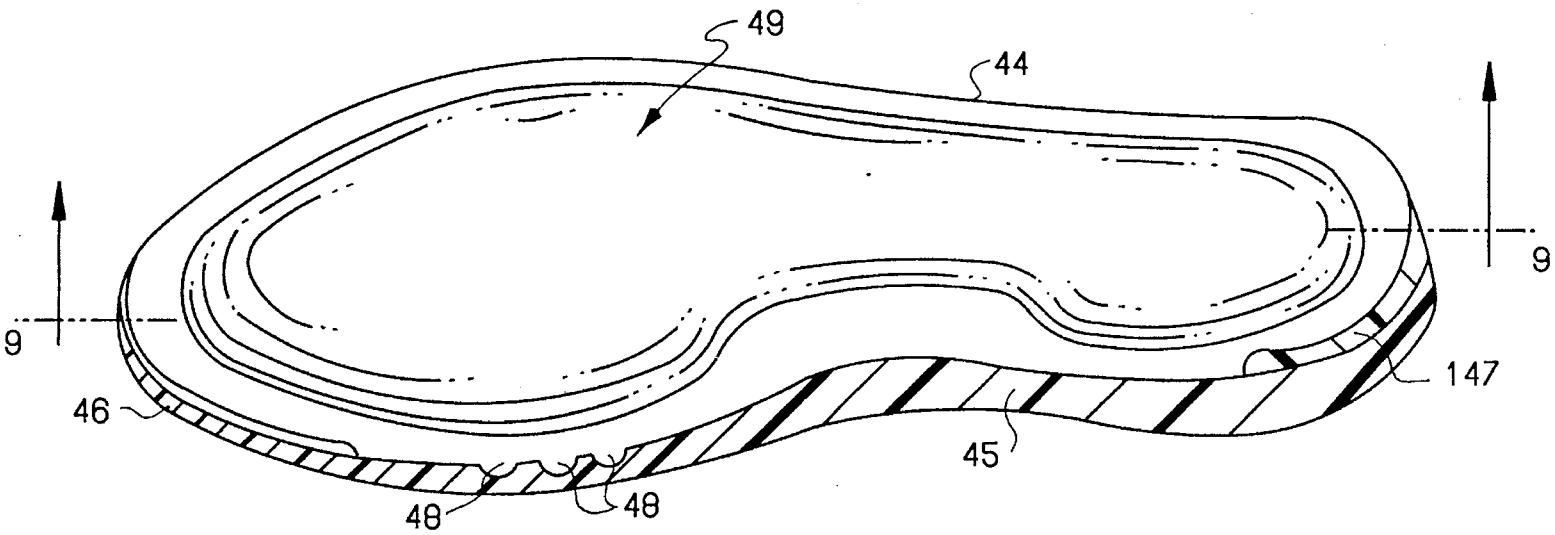
FIG. 8 is a perspective view of another embodiment of the invention.
Figure 9:
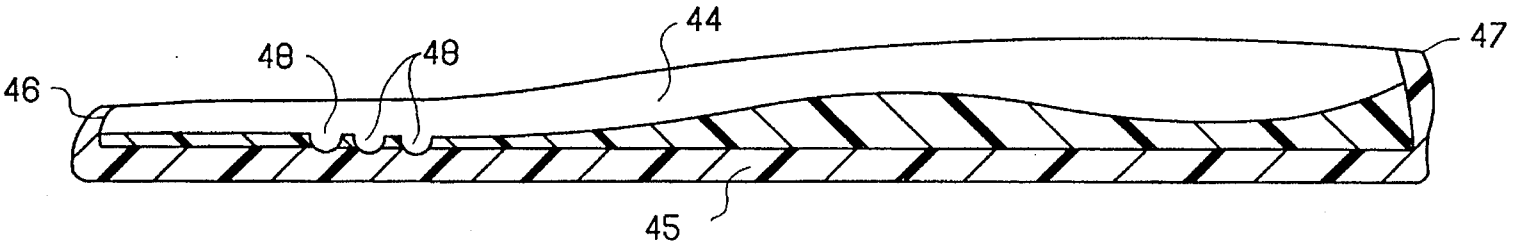
FIG. 9 is a transverse cross-section along lines 9—9 of FIG. 8.

FIGS. 8 and 9 illustrate another embodiment of the invention wherein the upper layer 44 is formed with a recessed portion 49 in the shape of the bottom of the user's foot, whereas the lower layer 45 may be similar to other embodiments. In this version, however, the forward end of the lower layer 45 extends to the front portion of the shoe to form a toe guard 46 and the rearward end of the lower layer 45 extends to the rear portion of the shoe to form a heel guard 47. As noted above, it is preferred to mold the upper and lower layers together since this forms a unitary structure. When gluing or other means of adhesively attaching the layers is used, grooves 48 may be provided on the upper surface of the lower layer for engagement with corresponding ribs positioned in the lower surface of the upper layer. These grooves 48 assure that the layers are in proper mating engagement when being attached by the adhesive so that the layers are positioned correctly with respect to each other in the final construction of the shoe sole. In addition, these grooves would increase the flexibility of the sole by providing lateral depressions which can bend more easily than a solid structure.

Figure 10:
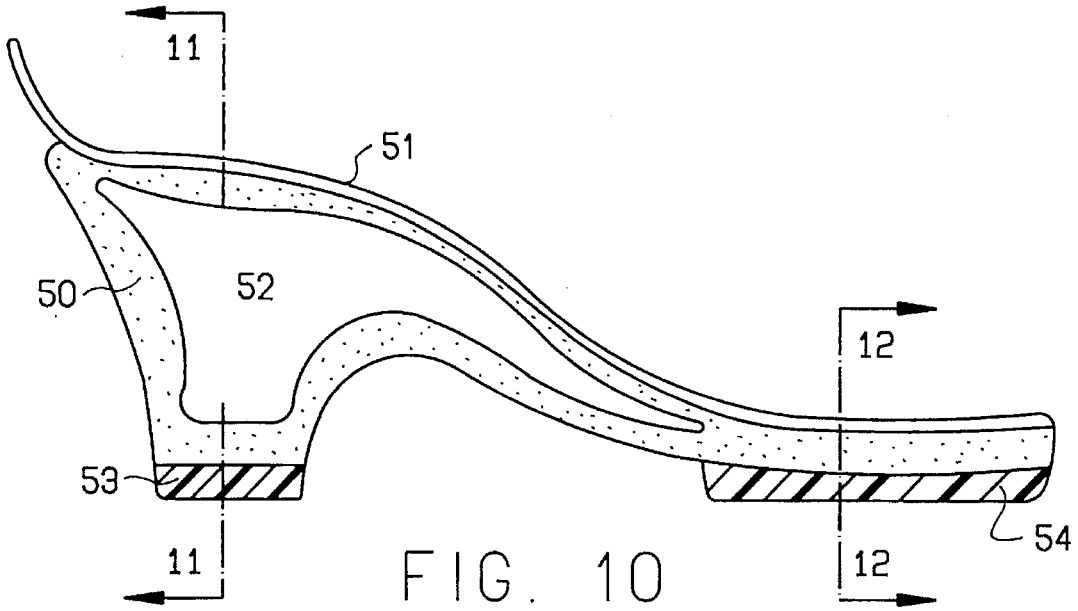
FIG. 10 is a perspective view of yet another embodiment of the invention.
Figure 11:
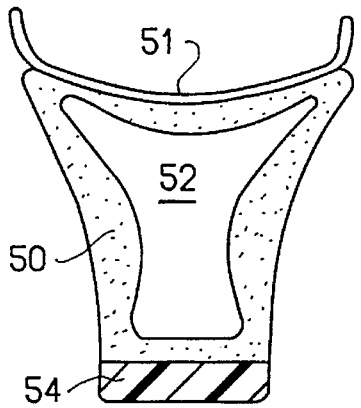
FIG. 11 is a transverse cross-section along lines 11—11 of FIG. 10.
Figure 12:
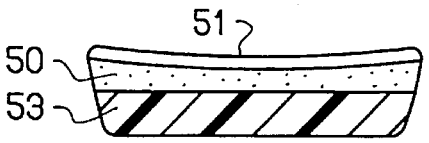
FIG. 12 is a transverse cross-section along lines 12—12 of FIG. 10.
Figure 13:
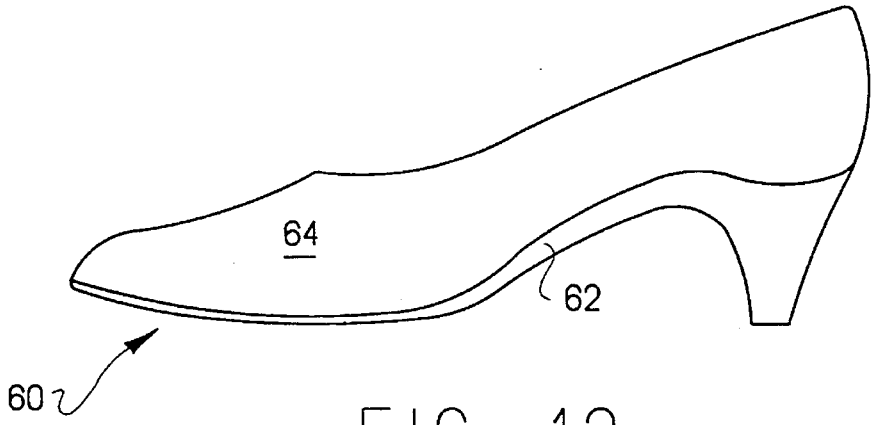
FIG. 13 is a side view of a double contour, double density ladies' dress shoe which is constructed in accordance with the present invention.

FIGS. 10–12 illustrate a women's high heel shoe in accordance with the invention. This shoe is formed of a molded body component 50, preferably of a polyurethane material, but other materials can be used, which has a last (foot form) 51 secured to the top thereof and which optionally encloses a stabilizer 52 therein. The outsole is formed of various pieces or strips of wear-resistant material. For example, wear resistant outsole materials 53 and 54 are provided at least in the areas of the heel and beneath the ball of the foot in the toe portion. The material used for these outsole layers 53, 54 is preferably rubber or an abrasion-resistant polyurethane which is harder than the polyurethane which may be used for the body component 50. As noted above, outsole materials which provide traction and abrasion resistance are used so that the shoe may have a relatively long useful life. These outsole materials can be made of high density polyurethane and integrally molded or can be made of other materials and glued, ultrasonically welded or otherwise attached to the body component. As described above, it is not necessary for the outsole materials 53 and 54 to be used in complete pieces in this embodiment, as it is also contemplated that a series of strips of such materials, applied horizontally, vertically, or in patterns can be selected to provide the optimum performance of the shoe in the desired wearing environment. Although the outsole materials are shown as being flat, they can be provided with contours, grooves or threads to increase the flexibility and traction of the sole, if desired.

FIGS. 13–21 illustrate a double contour, double density ladies' dress shoe 60 which is constructed in accordance with the present invention. Specifically, this shoe includes a lower support layer 62, which can be made in one piece as shown from a plastic or rigid foam material, and an upper 64. The lower support layer 62 must be made of a sufficiently rigid material to provide the necessary support to span the areas between the user's heel and toes (shank support). Thus, the stiffness and hardness of the material must be tailored to the type of shoe, with the higher spike heels requiring a stiffer material than would be used for shoes having low or moderate height heels. The lower support layer 62 may also include an outsole of a relatively harder, wear resistant material as a single layer covering the entire bottom surface of layer 62 or in the form of a series of strips positioned at least beneath the ball and toe area as well as beneath the heel area, as shown in the embodiment of FIG. 10.

Figure 14:
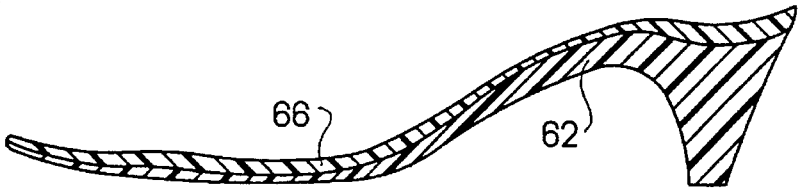
FIGS. 14–16 are longitudinal sectional views of three alternative embodiments for the shoe of FIG. 13.
Figure 15:
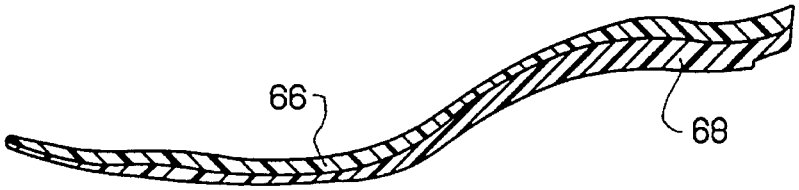
Figure 16:
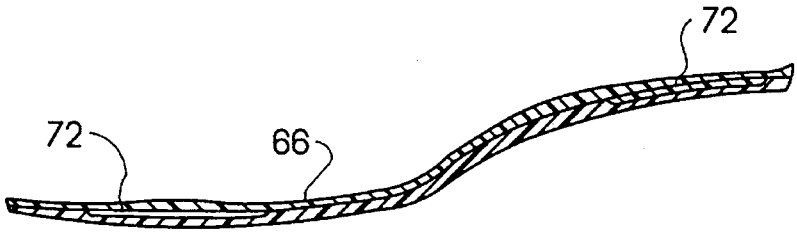

The construction of the lower support layer 62 and the various upper layers which may be positioned upon it are shown in FIGS. 14–16. The lower support layer 62 of FIG. 14 includes an integral heel for strength, and has an upper surface which is slightly contoured in the heel area, preferably by being slightly raised along the outer perimeter to provide cushioning to the heel of the user. The remaining upper surface of layer 62, i.e., the toe and instep portions, may be flat or may include raised areas for additional cushioning and support for the user's foot. Upon the upper surface of layer 62 is provided a foam layer 66, which, as shown in other Figures, preferably has an uppermost surface which is contoured to be complemental to the foot of the user. This layer 66 is made of a material which is softer than that of the lower layer 62. For example, the lower layer could be made of a polyurethane having a Shore A hardness of about 60 to 90 or higher, while the upper layer could be made of a softer polyurethane or EVA (ethyl vinyl acetate) having a Shore A hardness of about 40 to 60. If desired, the upper surface of foam layer 66 can be configured to include a raised portion in the toe area, a cupped heel area and an instep arch for additional cushioning and support of the user's foot. However, by contouring the upper surface of the lower support layer 62, only a single upper foam layer would be needed to provide sufficient support and cushioning to the user's foot.

Instead of lower support layer 62, a conventional lasting board made of heavy paper, cardboard, or another fairly rigid material, can be used as the support surface for the shoe. A single piece foam layer, which is similar to upper layer 66 described above, is then attached to this board, along with an upper 64 and an outsole. This single piece foam layer may be contoured as described above with regard to foam layer 66, and the upper surface is preferably configured to be complemental to the user's foot. This foam layer may have also have different densities to provide different levels of cushioning to different portions of the wearer's foot. If desired, a covering can be placed upon the top surface of the foam layer. This covering, which may be made of leather, cambrelle or soft polyurethane, is commonly referred to as a sock liner. Thus, the entire shoe can be constructed from a minimum number of components, while also providing a high level of comfort and cushioning to the user's foot.

FIG. 15 illustrates an embodiment which is similar to that of FIG. 14, except that the rigid support layer 62 does not include an integrally molded heel. Instead, a separate heel made of a rigid thermoplastic material is attached to the layer 62. The upper surface of the support layer 62 and the foam layer 66 could be configured in the same manner as described above in FIG. 15.

Figure 18:
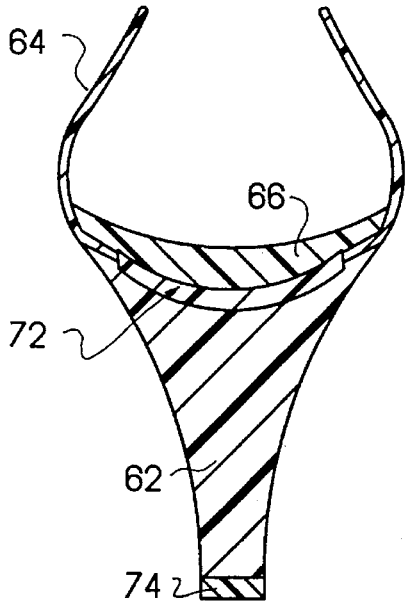

The embodiment of FIGS. 16 and 18 is similar to that of FIG. 15 except that shock foam inserts 72 are included beneath the toe and heel portions of foam layer 66. These shock foam inserts 72 are made of an impact absorbing foam and are provided for shoes which will experience relatively heavy or large shock forces, such as would typically occur during extended walking, standing, or other lengthy or strenuous physical activities. This construction provides the greatest degree of comfort when the shoe is used for those purposes.

Figure 17:
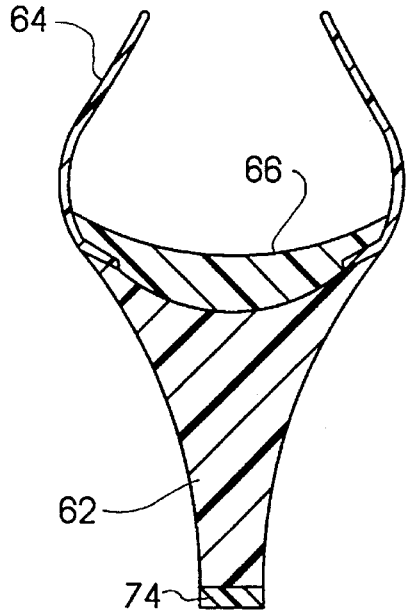
FIGS. 17–18 are lateral sectional views taken across the width of the shoes of FIGS. 15–16 at the heel thereof.

FIGS. 17 and 18 illustrate the attachment of the upper 64 to the support layer 62 in the heel area for the shoes of FIGS. 15 and 16, respectively, while FIG. 18 further illustrates the positioning of the shock foam insert 72 in the heel area for the shoe of FIG. 17. In these Figures, an outsole 74 is shown on the bottom surface of the heel.

Figure 19:
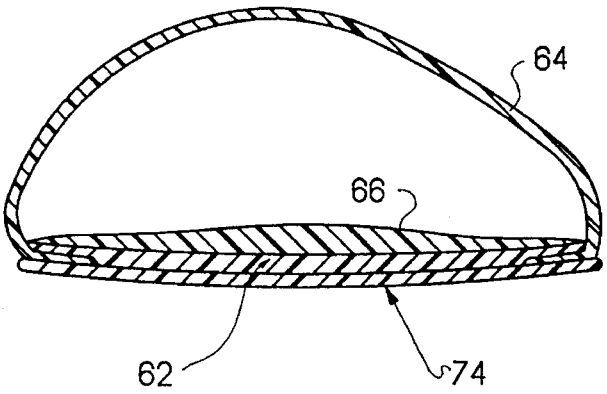
FIGS. 19–21 are lateral sectional views taken along the length of the shoe of FIG. 13 at the forefront thereof for the three embodiments of FIGS. 14–16.
Figure 20:
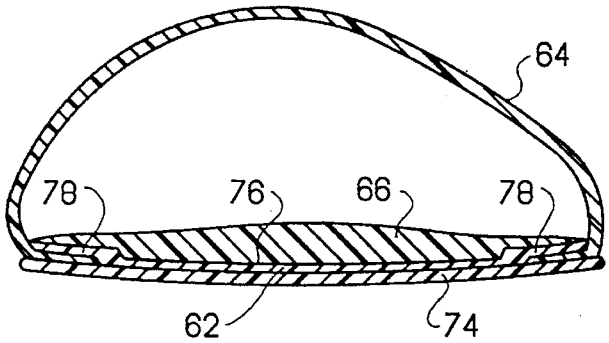
Figure 21:
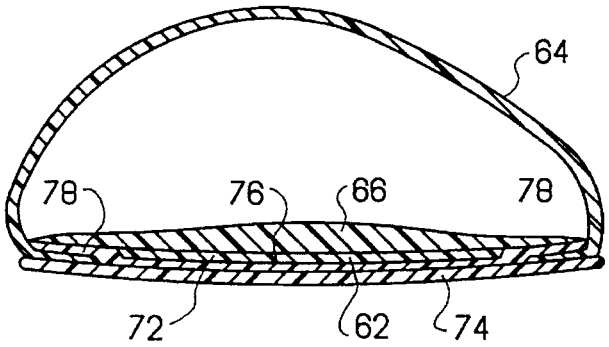

FIG. 19 illustrates the forefoot area of the shoe of FIG. 15 in cross-section to detail the attachment of the upper 64 to the support layer 62. This figure illustrates a non-radial wrap construction for the upper 64, in that it does not surround the foot but is secured between layers 62 and 74. An outsole 74 is also shown. In FIG. 20, a slightly different configuration is provided for the support layer 62, in that it has a raised perimeter 78 and a relatively flat inner area 76. In this arrangement, the raised perimeter portions 78 provide support for the perimeter of the user's foot, as well as room for attachment of the upper 64. It is desirable for a shock foam insert to be utilized with an upper foam layer that has a raised portion in the toe area, as shown in FIG. 20. Also, the arch and heel areas of the upper foam layer 66 can also be raised or contoured to provide an upper surface which is complementary to the foot of the user. FIG. 21 illustrates the positioning of the shock foam insert 72 in the toe area for the shoe of FIG. 16 as well as the attachment of the upper 64 and outsole 74 to the support layer 62.

Figure 23:
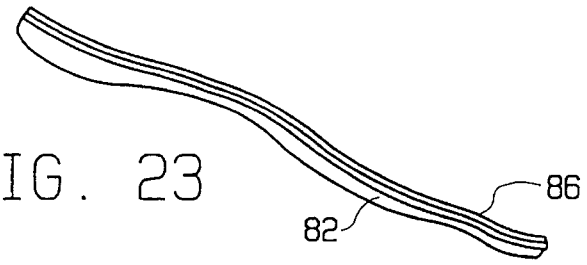
FIGS. 22 and 23 together present an exploded view of a sports shoe which is constructed in accordance with the present invention.
Figure 22:
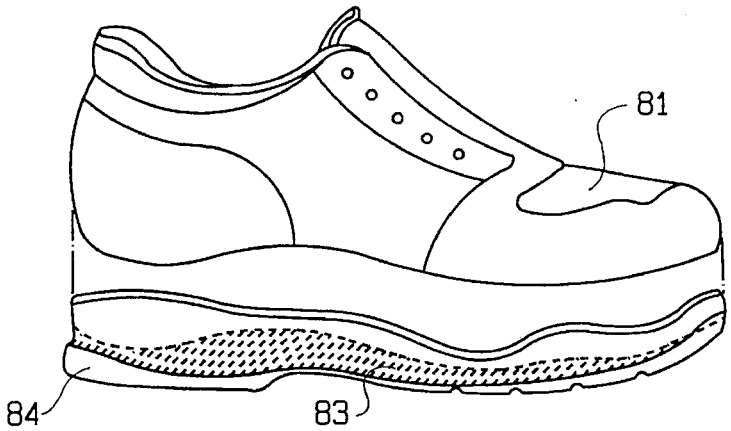

FIGS. 22–26 illustrate a sport or walking shoe made in accordance with the present invention. The shoe depicted in FIG. 22 comprises an upper 81, which may be made of leather, canvas, nylon, man-made materials, or any flexible material having sufficient strength. The midsole has a contoured firm lower 83 in accordance with the present invention as described above. The outsole 84 is made of rubber or a rugged polyurethane elastomer or other suitable wear-resistant material. FIG. 23 shows a soft contoured insert 82, which provides a footbed in accordance with the present invention. The insert, the upper surface of which may be fully or partially covered by a sockliner 86, is designed to be inserted into the shoe and to rest upon the radial wrap 85 that constitutes the shoe's upper in the area where said radial wrap covers the midsole 83. If desired, the insert may be secured to the radial wrap by an adhesive. Also, this insert 82 can be made in any of the manners described in U.S. Pat. No. 5,205,573.

Figure 24:
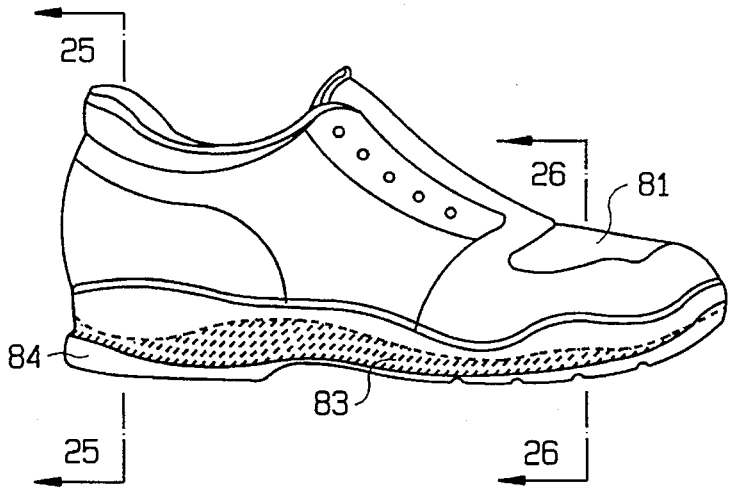
FIG. 24 is a side view of a sports shoe which is constructed in accordance with the present invention.
Figure 25:
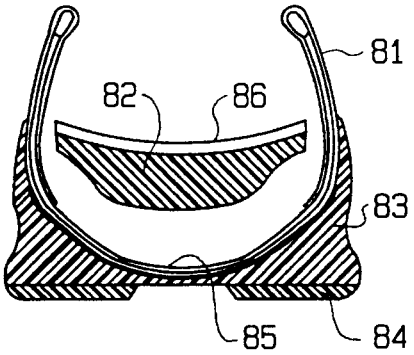
FIG. 25 is a transverse cross-section along lines 25—25 of FIG. 24.
Figure 26:
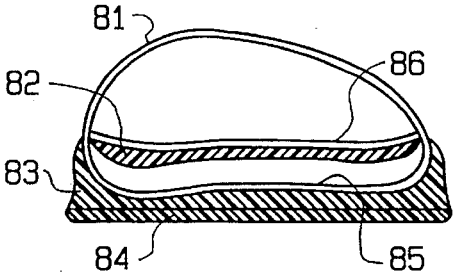
FIG. 26 is a transverse cross-section along lines 26—26 of FIG. 24.

FIG. 24 illustrates the shoe in assembled form, indicating the upper 81, the midsole 83, and the outsole 84, as well as the locations of the two cross-sections shown in FIGS. 25 and 26. FIG. 25 illustrates the heel area of the shoe of FIG. 24 in cross-section. In FIG. 25, the outsole 84 and the contoured midsole 83 are shown in their actual positions, but the footbed 82 is shown elevated in order to detail its relative positioning within the heel area of the shoe. Likewise, in FIG. 26, the outsole 84, the contoured midsole 83, and the upper 81 are shown in their actual positions, but the footbed 82 is shown elevated in order to detail its relative positioning within the toe area of the shoe. In both FIGS. 25 and 26, it is clear that the footbed will rest upon the radial wrap. It is possible that upper 81 will not entirely wrap around and under footbed 82, but will attach to the upper inside portions of midsole 83.

Having thus clearly described our invention in a manner which is fully understandable to persons skilled in the art, it is intended that the appended claims cover the preferred embodiments as well as any and all modifications which may be devised by such persons but which would fall within the true spirit and scope of the present invention.

What is claimed is:

1. A composite shoe having a toe area, arch area, and a heel area comprising:

a lower shaped support layer having an upper surface, a lower surface, a greater relative thickness around the periphery of the heel area and in the arch area, and the upper surface having an irregular contoured upper stabilizing surface for the wearer's foot;

a shoe upper attached to the upper surface of the lower layer;

an upper cushioning layer of a material which is softer than that of said lower layer and which is positioned above and in face-to-face relation with the lower layer, said upper cushioning layer having a varying thickness, a pre-shaped three-dimensional contour which is complementary to the bottom surface of the wearer's foot, and said upper cushioning layer having an increased height around the periphery of the heel area and in the arch area, thus forming a cupped heel and a raised arch support with the three dimensional contour in the arch area having a side-to-side height profile that varies along an arcuate path from a relatively lower point on the lateral portion of the layer to a relatively higher point on the medial portion of the layer to form a raised arch support, wherein the upper cushioning layer has a smaller thickness around the periphery of its heel and arch area, thereby providing an irregular contoured upper stabilizing surface for cushioning the wearer's foot; and an outsole secured to at least a portion of the lower surface of the lower support layer and comprising at least one strip of wear-resistant material.

2. The composite shoe of claim 1 wherein the lower layer comprises a lasting board and the upper layer comprises a one piece molded polyurethane or EVA material.

3. The composite shoe of claim 3 wherein the shoe upper is attached to peripheral portions of the lasting board by an adhesive.

4. The composite shoe of claim 3 which further comprises shock foam inserts beneath at least one of the toe portion of the upper layer and the heel portion of the upper layer.

5. The composite shoe of claim 4 wherein the lasting board includes raised perimeter portions and a relatively flat central portion in the toe area with the shoe upper attached to the lasting board.

6. The composite shoe of claim 1 which further comprises a sock liner provided upon the upper surface of the upper layer.

7. The composite shoe of claim 6 wherein the sock liner and upper layer form an integral component which is inserted into the shoe upper.

8. The composite shoe of claim 1 wherein the upper layer is attached to the shoe upper by an adhesive.

9. The composite shoe of claim 1 wherein the lower layer includes an integral heel, and the toe and instep portions include areas of increased cross-sectional thickness for additional cushioning and support of the user's foot.

10. The composite shoe of claim 1 wherein the lower layer includes a tapered portion that extends along side portions of the shoe upper.

11. The composite shoe of claim 1 wherein at least a portion of the upper layer includes a sock liner thereon.

12. The composite shoe of claim 1 wherein at least one of the upper layer or the lower layer has an increased cross-sectional thickness central portion in the toe area which thickness decreases to the periphery thereof.

13. The composite shoe of claim 1 wherein a portion of the outsole extends to the upper layer along at least a portion of the lower layer.

14. The composite shoe of claim 1 wherein an outsole is formed from a plurality of strips.

15. The composite shoe of claim 1 wherein a first strip covers the toe area of the lower layer and the adjacent area beneath the ball of the user's foot, and a second strip covers the heel area of the lower layer.

16. The composite shoe of claim 1 wherein the upper cushioning layer has different densities to provide different levels of cushioning to different portions of the wearer's foot.

17. The composite shoe of claim 1 wherein the shoe upper comprises a mixed assembly of radial wrap and non-radial wrap pieces.

18. The composite shoe of claim 1 wherein the increased thickness of the lower layer in the heel area is positioned directly beneath the upper layer and the increased thickness of the raised arch support of the lower layer is positioned directly beneath the arch support of the upper layer.

19. The composite shoe of claim 1 wherein the shoe upper comprises a radial wrap in the toe area and a non-radial warp extending to the heel area;

wherein a sock liner is secured to the upper surface of the upper cushioning layer; and wherein the lower layer includes tapered portions extending along side portions of the non-radial wrap in the heel portion of the shoe upper.

20. A composite shoe having a toe area, arch area, and a heel area comprising:

a lower shaped support layer having an upper surface, a lower surface, a greater relative thickness around the periphery of the heel area and in the arch area, and the upper surface having an irregular contoured upper stabilizing surface for the wearer's foot;

a shoe upper attached to the upper surface of the lower layer wherein the shoe upper comprises a radial wrap at least in the toe area;

an upper cushioning layer of a material which is softer than that of said lower layer and which is positioned above and in face-to-face relation with at least one of the radial wrap and the upper surface of the lower layer, said upper cushioning layer having a varying thickness, a pre-shaped three-dimensional contour which is complementary to the bottom surface of the wearer's foot, and said upper cushioning layer having an increased height around the periphery of the heel area and in the arch area, thus forming a cupped heel and a raised arch support with the three dimensional contour in the arch area having a side-to-side height profile that varies along an arcuate path from a relatively lower point on the lateral portion of the layer to a relatively higher point on the medial point of the layer to form a raised arch support, wherein the upper cushioning layer has a smaller thickness around the periphery of its heel and arch area, thereby providing an irregular contoured upper stabilizing surface for cushioning the wearer's foot; and an outsole secured to at least a portion of the lower surface of the lower support layer and comprising at least one strip of wear-resistant material.

21. The composite shoe of claim 20 which further comprises a sock liner provided upon the upper surface of the upper layer.

22. The composite shoe of claim 21 wherein the sock liner and upper layer form an integral component which is inserted into the shoe upper.

23. The composite shoe of claim 22 wherein the radial wrap continues throughout the arch area and heel area along the entire upper surface of the lower layer and the upper layer rests upon the radial wrap in contact therewith.

24. The composite shoe of claim 23 wherein the bottom surface of the upper layer has a contour complementary to the upper surface of the radial wrap and the upper layer is attached to the radial wrap by an adhesive.

25. The composite shoe of claim 24 wherein the lower layer includes a tapered portion that extends along the side portions of the radial wrap.

26. The composite shoe of claim 20 wherein the radial wrap continues throughout the arch area and heel area forming a base for the upper layer and the bottom surface of the upper layer has a contour complementary to the upper surface of the radial wrap.

27. The composite shoe of claim 1 wherein the at least one strip of wear resistant material is positioned upon the lower layer at least in one of the heel area and in the area beneath the ball of the foot.

28. The composite shoe of claim 20 wherein the at least one strip of wear resistant material is positioned upon the lower layer at least in one of the heel area and in the area beneath the ball of the foot.

29. The composite shoe of claim 21 wherein the increased thickness of the lower layer in the heel area is positioned directly beneath the upper layer and the increased thickness of the raised arch support of the lower layer is positioned directly beneath the arch support of the upper layer.

* * * * *